United States Patent [19]

Schultz

[11] Patent Number: 4,756,625

[45] Date of Patent: Jul. 12, 1988

[54] MIXING APPARATUS FOR FLUID MATERIALS

[75] Inventor: Carl L. Schultz, Plymouth, Mich.

[73] Assignee: Sealant Equipment & Engineering, Inc., Oak Park, Mich.

[21] Appl. No.: 880,041

[22] Filed: Jun. 30, 1986

[51] Int. Cl.[4] ..... B01F 7/16; B01F 15/06

[52] U.S. Cl. ..... 366/317; 366/149; 366/250

[58] Field of Search ..... 366/315, 316, 317, 250, 366/149, 340, 349, 126

[56] References Cited

U.S. PATENT DOCUMENTS

| | | | |
|---|---|---|---|
| 860,031 | 7/1907 | Jones | 366/317 |
| 1,327,395 | 1/1920 | Kelley | 366/250 |
| 1,670,593 | 5/1928 | Miller | 366/317 |
| 2,729,545 | 1/1956 | Reman et al. | 23/270.5 |
| 2,758,915 | 8/1956 | Vodonik | 23/285 |
| 3,081,069 | 3/1963 | Oakes | 366/317 |
| 3,235,231 | 2/1966 | Dietze et al. | 366/177 |
| 3,377,139 | 4/1968 | MacGregor et al. | 23/285 |
| 3,603,563 | 9/1971 | Holland | 366/317 |
| 3,672,645 | 6/1972 | Terrels et al. | 366/250 |
| 3,746,216 | 7/1973 | Frederick | 222/137 |
| 3,902,850 | 9/1965 | Lehwert | 366/149 |
| 4,176,972 | 12/1979 | Stiling | 366/317 |
| 4,316,673 | 2/1982 | Speer | 366/340 |

*Primary Examiner*—Harvey C. Hornsby
*Assistant Examiner*—Joseph S. Machuga
*Attorney, Agent, or Firm*—Basile and Hanlon

[57] ABSTRACT

A mixer for mixing fluid materials such as an adhesive resin and a catalyst as the materials flow from separate supply sources to a dispensing nozzle includes a disc like rotor having a plurality of balls of uniform diameter fixedly mounted in the rotor to project symmetrically from opposite sides of the rotor. The rotor is driven in rotation within a cylindrical chamber having walls providing small clearances for the rotor, the chamber having a fluid inlet and a fluid outlet in the opposed chamber end walls coaxial with the rotor. The balls are arranged in a pattern which thoroughly mixes the fluid while imposing a minimum restriction to the flow of fluid through the mixer.

9 Claims, 1 Drawing Sheet

MIXING APPARATUS FOR FLUID MATERIALS

BACKGROUND OF THE INVENTION

Field of the Invention

The present invention is directed to an improved mixer useful for mixing materials as the materials are advanced from pressurized supply sources through a closed fluid system to a dispensing nozzle.

The mixer of the present invention is especially designed for use in systems such as those employed to dispense a bead of adhesive or a sealant material upon a work piece. These materials typically are applied as a somewhat viscous material made up of a resin and a catalyst. In the case of an adhesive, for example, the resin is substantially inert until it is mixed with the catalyst, at which time the adhesive is activated and begins to set up or harden almost immediately. Because of this characteristic, the resin and catalyst are maintained in separate supply sources and the mixing is accomplished as the materials flow from the separate sources to the dispensing nozzle.

It is customary to regulate the proportions of the resin and catalyst in the mixture by discharging the resin and catalyst from their separate sources by controlled positive displacement devices whose separate outlets are commonly connected to a mixer whose outlet is in turn directly connected to the dispensing nozzle. The pressures generated by the positive displacement devices are employed to establish the flow of material through the mixer and discharge nozzle.

The mixer must thus perform the somewhat contradictory functions of thoroughly mixing two or more materials while the materials are flowing along a flow path without presenting any substantial restriction to the flow of material from the supply source to the dispensing nozzle.

The present invention is especially directed to a mixer capable of performing both of the foregoing functions.

SUMMARY OF THE INVENTION

In accordance with the present invention, a mixer employs a rotor in the form of a flat circular plate having a plurality of balls fixedly mounted in the plate to project symmetrically from the oppposite side surfaces of the plate. The rotor is mounted for rotation within a cylindrical chamber having opposed end walls spaced from each other by a distance slightly greater than the diameter of the balls so that the rotor may rotate with a slight clearance between the balls and the opposed end walls of the chamber. The diameter of the chamber exceeds the diameter of the rotor by an amount such that a relatively unrestricted flow path for material from one side of the rotor around its periphery to the other side is established. The inlet and outlet of the chamber are coaxial with the axis of the rotor and material to be mixed is fed under pressure into the inlet, flows radially outwardly along one side face of the rotor, around the periphery of the rotor and radial inwardly across the opposite face to the outlet. During this passage, the projecting portions of the balls of the rotor are rotated through the material to thoroughly mix the material as it passes through the chamber.

The balls are arranged on the rotor in a pattern such that substantially the entire radial extent of the chamber between the inlet and outlet openings and the periphery of the rotor are thoroughly swept by the balls as the rotor is driven in rotation. At the same time, the balls are spaced from each other by distance such that no substantial restriction to the flow path of the material through the mixer is imposed.

In another embodiment, the rotor may be driven by a drive shaft connected to an air motor. Cooled air from the motor is directed via a passage to a cooling collar positioned around the cooling chamber, thereby dissipating waste heat build-up generated by the mixing motor.

Other objects and features of the invention will become apparent by reference to the following specification and to the drawings.

DESCRIPTION OF THE PREFERRED EMBODIMENTS

Figure 1:
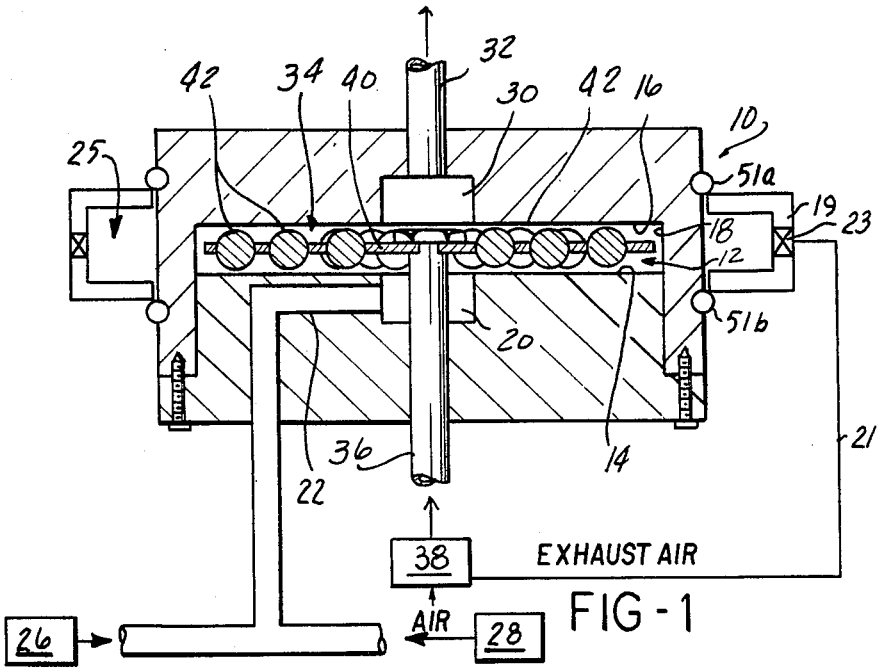
FIG. 1 is a cross-sectional view taken in an axial plane of a mixer embodying the present invention, with certain parts shown schematically or broken away.

Referring first to FIG. 1, a mixer embodying the present invention includes a housing designated generally as 10 formed with a cylindrical mixing chamber designated generally 12 defined by spaced end walls 14 and 16 and a cylindrical side wall 18. An inlet 20 opens into chamber 12 through end wall 14 and is connected via inlet passage 22 through housing 10 to an external T fitting 24 which is in turn connected to two material supply sources schematically indicated at 26 and 28.

Material sources 26 and 28 may respectively contain a resin and a catalyst which are dispensed from sources 26 and 28 by positive displacement devices control in a known manner to assure that a properly proportioned flow of resin and catalyst under pressure is supplied to T fitting 24 to be combined at the fitting and to flow via passage 22 into inlet 20 and thence into chamber 12. A chamber outlet 30 opens into chamber 12 through end wall 16 and is connected to an outlet conduit 32 which conducts material from mixing chamber 12 to a point of use, such as a dispensing nozzle. It will be noted that both inlet 20 and outlet 30 open into chamber 12 coaxially of the chamber axis.

A rotor designated generally 34 is disposed within chamber 12 and fixed to the end of a drive shaft 36 rotatably received within housing 12 and driven in rotation by an externally located drive schematically illustrated at 38.

Rotor 34 is constructed with a flat circular plate 40 having a plurality of balls 42 fixedly mounted within plate 40 to project symmetrically from the opposed sides of plate 40. The diameter of balls 42 is slightly less than the distance between the opposed end walls 14 and 16 of chamber 12, and plate 40 is mounted midway between end walls 14 and 16 so that rotor 34 may be driven in rotation with a slight clearance existing between the balls and end walls of the chamber 12. The diameter of the circular plate 40 of rotor 34 is less than the internal diameter of the cylindrical side wall 18 of chamber 12 to provide an adequate clearance between the periphery of plate 40 and chamber side wall 18 to enable free flow of material around the periphery of the rotor as the material flows from inlet 20 to outlet 30.

Balls 42 may be conveniently assembled in plate 40 by forming bores through the plate to snugly receive the ball and bonding the balls in a place by a suitable bonding material.

The balls are located on the plate in a specific arrangement or pattern to assure a thorough mixing of material. From FIG. 1 it is believed apparent that plate 40 requires material flowing from inlet 20 to pass radially outwardly across one surface of the plate, then around the periphery of plate 40 and radially inwardly across the opposite face of the plate to outlet 30. The projecting portions of balls 42 sweep laterally across this radial flow on both sides of the plate 40. Because the direction of movement of the balls is normal to the radial flow which would occur if the rotor were not driven in rotation, the fluid flowing through the device is urged into a somewhat turbulent spiral flow path and thoroughly mixed during its passage through the mixer. To assure thorough mixing, the balls are preferably arranged upon plate 40 in a pattern such that the projecting portions of the balls traverse overlapping annular paths which substantially completely sweep the radial extent of the chamber between the inlet and outlet 20 and 30 and the outer periphery of rotor 34.

According to one preferred embodiment, spaced end walls 14 and 16 are flat, smooth and substantially free of any obstruction. Because of this feature, they may be easily cleaned of any adhering material.

Figure 2:
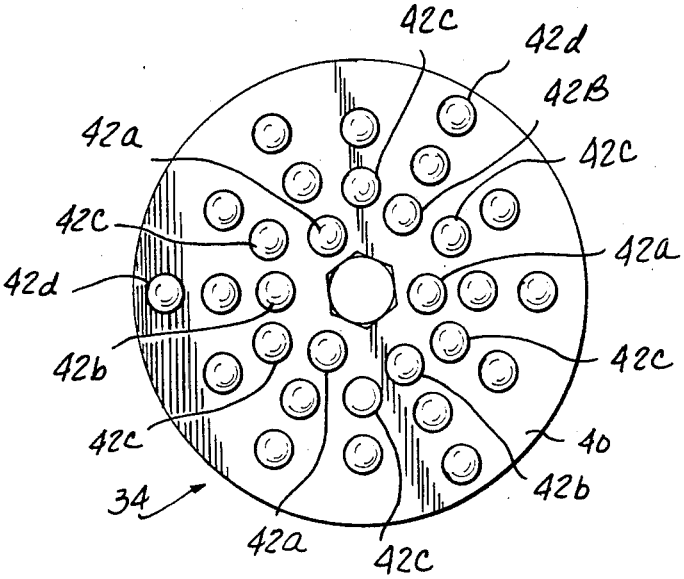
FIG. 2 is a front view of the rotor of the mixer of FIG. 1.

According to one preferred embodiment, illustrated in FIG. 2, the balls are arranged upon plate 40 in groups of two and three, with each group having the centers of the balls of that group lying on a common radius from the axis of rotor 40. The radii on which the various groups of balls are disposed are spaced at 30 degree intervals from each other entirely around the axis and the balls within a given group have their centers spaced from each other by a distance approximately equal to one and one half times the ball diameter.

The spacing of the balls of a group radially from the axis of rotor 40 varies from group to group, and in the pattern shown in FIG. 2, three different spacing arrangements are shown.

A first group spacing is represented by the groups at the twelve o'clock, four o'clock and eight o'clock positions in FIG. 2. A second arrangement is presented by the groups at the one o'clock, three o'clock, five o'clock, seven o'clock, nine o'clock, and eleven o'clock positions, while still a third arrangement is assigned to the groups at the two o'clock, six o'clock and ten o'clock positions of FIG. 2.

This third group arrangement finds the radially innermost ball of that group **42*a* located closer to the rotor axis than the radially innermost balls of either of the other two groups. The center of the balls 42*a* of the third group are closer to the axis of rotor 40 than radially innermost balls 42*b* of the first groups by a distance approximately equal to one half of the ball diameter. The radially innermost balls 42*b* of the first group are in turn closer to the axis of rotor 40 than the radially innermost balls of the second group 42*c*** by a distance equal to one half of the ball diameter.

Because the balls of all groups have a center to center spacing of approximately one and one half ball diameters, the three group arrangement described above assures that the annular paths of the balls will radially overlap each other over the radial extent between the inner most ball **42*a* of the third group and the outer most ball 42*d*** of the first group. There are twelve groups of balls, the balls of the first and third groups including three balls each and the rotor having three first and three third groups. The second groups of balls includes only two balls; however there are six second groups. This arrangement induces a somewhat wavey spiral flow of fluid which substantially improves the mixing action.

Preferably the drive 38 is an air motor drive of a conventional type. The air motor 38 has provisions for ambient air to enter and exhaust air to leave, as shown in FIG. 1. The operation of the air motor 38 lowers the temperature of the air passing through it and results in the emission of a very cooled exhaust air. The cooled exhaust air from the air motor 32 is directed through cooling collar 19 via passage 21 and air inlet 23. The cooling collar 19 is U-shaped in cross-section, and air inlet 23 permits the passage of cooled air therethrough. The U-shape of cooling collar 19 defines a hollow cavity 25 which receives the cool air from air inlet 23. The inside diameter of the arms of the "U" formed by cooling collar 19 is sufficiently larger than the outside diameter of cylindrical sidewall 18 to permit air from hollow chamber 25 to flow through gaps therebetween and be dissipated in the environment. Cooling collar 21 is positioned around cylindrical sidewall 18 so that hollow chamber 25 is in close proximity to cylindrical mixing chamber 12.

Cooling collar 21 may be retained on housing 10 by any conventional retaining means. In a particularly preferred embodiment, the retaining means comprises O-rings **51*a* and 51*b*, whereby cooling collar 21** is prevented from slipping out of place, but can be easily removed for servicing.

In operation, cooled air passes through cooling collar 21 via passage 19 and air inlet 23, whereupon it enters hollow chamber 25. After absorbing heat buildup from mixing chamber 12 generated from the mixing process, the now heated air passes through the gaps formed between cooling collar 21 and cylindrical sidewall 18 and is dissipated into the environment.

While one embodiment has been described in detail, it will be apparent to those skilled in the art the disclosed embodiment may be modified. Therefore, the foregoing description is to be considered exemplary rather than limiting, and true scope of the invention is that defined in the following claims.

I claim:

1. A mixing device for mixing fluids comprising a housing having a cylindrical mixing chamber therein defined by a continuous cylindrical side wall and a pair of spaced apart parallel end walls, said end walls being substantially flat and free of obstruction, the diameter of said chamber being substantially greater than its axial extent between said end wall, means defining fluid inlet and fluid outlet passages in said housing respectively opening into said chamber through said end walls coaxially of said chamber, a flat circular disc like rotor of a diameter slightly less than that of said chamber mounted for coaxial rotation within said chamber, the thickness of said rotor being substantially less than the distance between said end walls and said rotor being located midway between said end walls, a plurality of balls fixedly mounted in said rotor, said balls being of a uniform diameter slightly less than the distance between said end walls and projecting symmetrically from the opposite side surfaces of said rotor, said balls being located on said rotor in a plurality of groups, each group consisting of at least two balls having their centers lying on a common radius of said rotor, the radii along which said groups of balls are located being uniformly angularly spaced about the axis of said rotor, the centers of the balls of a first group being radially offset from the center of the balls of an adjacent second group by a distance approximately equal to one half said uniform diameter, such that upon rotation of said rotor the portions of the balls projecting from said rotor sweep substantially the entire radial extent of said chamber between said inlet and outlet openings and the periphery of said rotor.

2. The invention defined in claim 1 wherein the centers of the balls of each group are spaced from each other by a distance approximately equal to one and one half times said uniform diameter.

3. The invention defined in claim 2 wherein the centers of the balls of said second group are radially offset from the centers of the balls of a third group adjacent said second group by a distance approximately equal to one half said uniform diameter.

4. The invention defined in claim 2 wherein the radii on which the groups of balls are located are disposed at 30 degree intervals around the axis of the rotor, said plurality of balls including three first groups of balls spaced at 120 degree intervals, six second groups spaced at 60 degree intervals and three third groups of balls spaced at 60 degree intervals.

5. The invention defined in claim 1 further comprising a means for imparting rotary motion to the rotor.

6. The invention defined in claim 5 wherein the means for imparting rotary motion comprises a drive shaft, the end of said drive shaft being fixed to the rotor, and a means for rotating the drive shaft, said rotation means comprising an air engine.

7. The invention defined in claim 6 wherein the cooled air exhausted by the air engine is directed via a passage through an air inlet contained in a cooling collar, said cooling collar being U-shaped in cross-section area and positioned around the cylindrical sidewall so as to define a hollow chamber in close proximity to the mixing chamber such that cooled air entering the hollow chamber will absorb heat buildup generated by the mixing process.

8. the invention defined in claim 7 wherein the inside diameter of the cooling collar is sufficiently larger than the outside diameter of the cylindrical sidewall to permit the passage of air therethrough.

9. The invention defined in claim 8 wherein the cooling collar is retained in position by at least one O ring.

* * * * *